US007640900B2

(12) United States Patent
Tateno et al.

(10) Patent No.: US 7,640,900 B2
(45) Date of Patent: Jan. 5, 2010

(54) VARIABLE VALVE OPERATING DEVICE

(75) Inventors: Manabu Tateno, Sunto-gun (JP); Shuichi Ezaki, Susono (JP); Toshiaki Asada, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 384 days.

(21) Appl. No.: 11/658,568

(22) PCT Filed: Aug. 30, 2005

(86) PCT No.: PCT/JP2005/016184

§ 371 (c)(1),
(2), (4) Date: Jan. 25, 2007

(87) PCT Pub. No.: WO2006/025564

PCT Pub. Date: Mar. 9, 2006

(65) Prior Publication Data

US 2009/0038567 A1 Feb. 12, 2009

(30) Foreign Application Priority Data

Aug. 31, 2004 (JP) ..... 2004-252511

(51) Int. Cl.
*F01L 1/34* (2006.01)

(52) U.S. Cl. ..... 123/90.16; 123/90.39; 74/569

(58) Field of Classification Search ..... 123/90.16, 123/90.2, 90.39, 90.44, 90.6; 74/559, 567, 74/569
See application file for complete search history.

(56) References Cited

U.S. PATENT DOCUMENTS 6,357,405 B1 3/2002 Tsuji et al.

FOREIGN PATENT DOCUMENTS

| | | |
|---|---|---|
| JP | A 06-093816 | 4/1994 |
| JP | A 06-307219 | 11/1994 |
| JP | A 07-063023 | 3/1995 |
| JP | A 2001-164911 | 6/2001 |
| JP | A 2002-371816 | 12/2002 |
| JP | A 2002-371819 | 12/2002 |
| JP | A 2003-239712 | 8/2003 |
| JP | A 2004-108302 | 4/2004 |

*Primary Examiner*—Ching Chang
(74) *Attorney, Agent, or Firm*—Oliff & Berridge, PLC

(57) ABSTRACT

The present invention relates to a variable valve operating device and makes it possible to inhibit friction during driving force transmission and provide high durability through the use of a compact configuration.

A first roller 170, which comes into contact with a drive cam surface 124 of a camshaft 120, has a larger diameter than a second roller 172, which comes into contact with a slide surface 156 of a swing member 150. A coupling shaft 174 couples the first roller 170 to the second roller 172 so that the rollers 170, 172 can rotate independently. The slide surface 156 is curved toward the drive cam surface 124.

4 Claims, 6 Drawing Sheets

LARGE LIFT
C0
P1
P2
P3i
P3f
102
104
106
110
112
120
122
124a
124b
132
150
152a
152b
156
160
162
164
166
170
172

124a
120
160
122
124b
166
164
170
172
P2
150
152b
P1
156
162
CO
132
P3f
112
110
106
102
104
SMALL LIFT 124b
122
120
160
P1
166
164
170
172
P2
152b
150
156
124a
162
134
CO
132
P3i
152a
112
110
106
102
104

VARIABLE VALVE OPERATING DEVICE

TECHNICAL FIELD

The present invention relates to a variable valve operating device for an internal combustion engine, and more particularly to a variable valve operating device that is capable of mechanically changing the operating characteristic of a valve.

BACKGROUND ART

A conventionally known variable valve operating device that is disclosed, for instance, by Japanese Patent Laid-open No. 2003-239712 mechanically changes the valve lift amount and valve timing in accordance with the operating state of an engine. In the variable valve operating device described in Japanese Patent Laid-open No. 2003-239712, a guide arm is fastened to a control shaft, which is positioned in parallel with a camshaft. One end of a follower is installed over the guide arm and allowed to swing freely. A swing cam is installed over the control shaft and allowed to swing freely, and a rocker arm is pressed against a surface of the swing cam. A first roller and a second roller, which can rotate independently of each other, are concentrically installed over the follower. The first roller is in contact with a valve cam of the camshaft, whereas the second roller is in contact with a contact surface that is formed opposite the swing cam surface of the swing cam.

When the control shaft rotates to vary the rotation position of the guide arm in a situation where the above configuration is employed, the follower becomes displaced to change the distance between the control shaft and the contact position between the swing cam and the second roller, thereby changing the lift amount of the valve. Further, when the circumferential position of the valve cam, which comes into contact with the first roller at the same rotation position of the camshaft, varies, the valve timing simultaneously changes. In other words, the variable valve operating device described in Japanese Patent Laid-open No. 2003-239712 is capable of simultaneously changing the valve's lift amount and valve timing by using a motor to control the rotation position of the control shaft.

Including the above-mentioned document, the applicant is aware of the following documents as a related art of the present invention.

[Patent Document 1]
Japanese Patent Laid-open No. 2003-239712
[Patent Document 2]
Japanese Patent Laid-open No. 2002-371819
[Patent Document 3]
Japanese Patent Laid-open No. 2004-108302
[Patent Document 4]
Japanese Patent Laid-open No. Hei7-63023
[Patent Document 3]
Japanese Patent Laid-open No. 2002-371816

DISCLOSURE OF INVENTION

When the variable valve operating device described in Japanese Patent Laid-open No. 2003-239712 is used, the valve cam transmits a driving force to the swing cam via the first and second rollers. When, as described above, a roller is used as a member that comes into contact with the valve cam, and another roller is used as a member that comes into contact with the swing cam, it is possible to reduce friction prevailing during driving force transmission and improve the fuel efficiency of an internal combustion engine.

However, when a roller is used as a driving force transmission member, it is necessary to pay attention to contact surface pressure (Hertzian stress) that is exerted between the roller and its mating member. When the valve cam is used for driving purposes in the variable valve operating device described in Japanese Patent Laid-open No. 2003-239712, a high contact surface pressure is exerted on the contact between the valve cam and the first roller and on the contact between the swing cam and the second roller due to reaction force generated by a valve spring and lost motion spring. Therefore, adequate durability might not be obtained depending on the materials and shapes of the members. The simplest method for reducing the contact surface pressure would be to enlarge the diameter of each roller. However, if the diameter of each roller is increased, it is necessary to increase the distance between the valve cam and swing cam accordingly. As a result, an increase in the roller diameter enlarges the size of the variable valve operating device.

The present invention has been made to solve the above problem. It is an object of the present invention to provide a compact, highly durable variable valve operating device that is capable of inhibiting friction that may arise during driving force transmission.

The above object is achieved by a variable valve operating device according to a first aspect of the present invention. The variable valve operating device mechanically changes the operating characteristic of a valve relative to the rotation of a camshaft. The variable valve operating device comprises a drive cam installed over the camshaft; a swing member that swings on a stationary shaft; a swing cam surface that is formed on the swing member, comes into contact with a valve support member, which supports the valve, and presses the valve in a lifting direction; a slide surface that is formed on the swing member so as to face the drive cam; an intermediate member that is positioned between the drive cam and the swing member and comes into contact with both the slide surface and a cam surface of the drive cam; a control shaft that is positioned in parallel with the camshaft and capable of changing the rotation position continuously or stepwise; and an interlock mechanism that changes the position of the intermediate member in interlock with the rotation of the control shaft; wherein the intermediate member includes a first roller, which has a large diameter and comes into contact with a cam surface of the drive cam; a second roller, which is positioned concentrically with the first roller, has a small diameter, and comes into contact with the slide surface; and a coupling shaft, which couples the first roller and the second roller so that the first roller and the second roller can rotate independently; and wherein the slide surface is curved toward the drive cam.

When, in the first aspect of the present invention, the camshaft rotates, its rotary motion is transmitted from the drive cam to the first roller and conveyed to the slide surface of the swing member via the second roller, which is coaxial with the first roller. In this instance, contact surface pressure is exerted between the first roller and the cam surface of the drive cam and between the second roller and the slide surface. However, the contact surface pressure between the first roller and the cam surface of the drive cam is reduced because the first roller has a larger diameter than the second roller. The contact surface pressure between the second roller and the slide surface is reduced because the slide surface is curved toward the drive cam surface. Further, since the second roller, which comes into contact with the slide surface, has a smaller diameter than the first roller, an increase in the distance between the slide surface and the cam surface of the drive cam is inhibited. Therefore, the first aspect of the present invention not only provides increased durability due to a decrease in the contact surface pressure, but also makes the whole variable valve operating device compact.

According to a second aspect of the present invention, there is provided the variable valve operating device as described in the first aspect, wherein the second roller is positioned on both sides of the first roller; and wherein the two second rollers come into contact with the slide surface to input a driving force to the slide surface.

According to the second aspect of the present invention, the driving force, which is input from the drive cam to the first roller, and the reaction force, which is input from the slide surface of the swing member to the second rollers on both sides, balance at the center of the coupling shaft. Therefore, it is possible to inhibit the coupling shaft from bending.

According to a third aspect of the present invention, there is provided the variable valve operating device as described in the second aspect, wherein the swing member is provided for each of the two second rollers; and wherein the valve is provided for each of the two swing members.

According to the third aspect of the present invention, a driving force can be uniformly transmitted to the two valves.

According to a fourth aspect of the present invention, there is provided the variable valve operating device as described in the first aspect, wherein the second roller is positioned between two units of the first roller; and wherein each of the two first rollers comes into contact with a cam surface of the drive cam to receive a driving force input from the drive cam.

According to the fourth aspect of the present invention, the driving force, which is input from the cam surface of the drive cam to the first rollers on both sides, and the reaction force, which is input from the slide surface to the second roller at the center, balance at the center of the coupling shaft. Therefore, it is possible to inhibit the coupling shaft from bending.

BRIEF DESCRIPTION OF DRAWINGS

FIG. 4A shows a state prevailing when a valve is closed and FIG. 4B shows a state prevailing when the valve is open;

FIG. 5A shows a state prevailing when the valve is closed and FIG. 5B shows a state prevailing when the valve is open;

BEST MODE FOR CARRYING OUT THE INVENTION

An embodiment of the present invention will now be described with reference to FIGS. 1 to 7.

[Configuration of Variable Valve Operating Device According to Present Embodiment]

Figure 1:
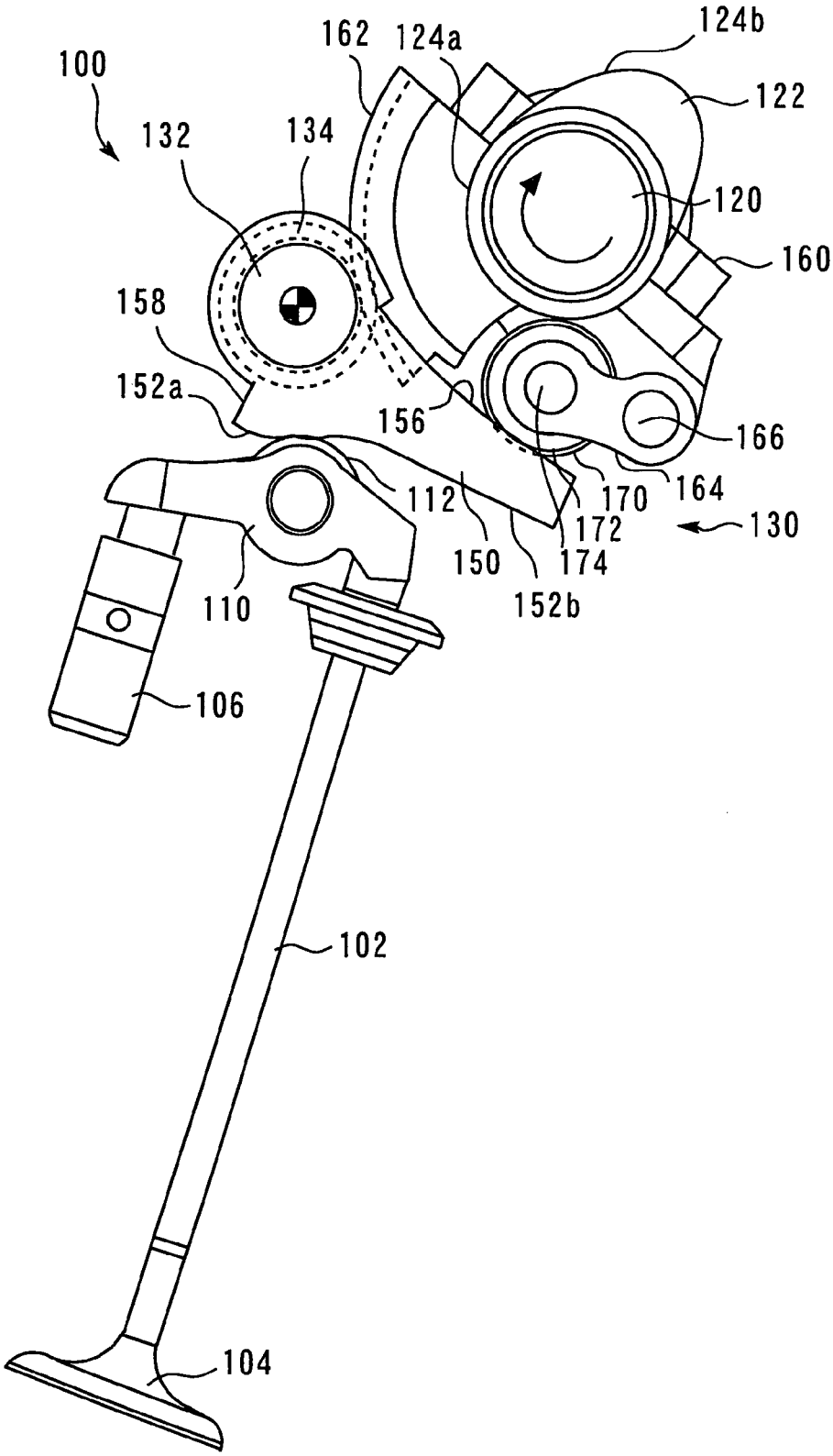
FIG. 1 is a side view illustrating the configuration of a variable valve operating device according to an embodiment of the present invention.

FIG. 1 is a side view illustrating the configuration of a variable valve operating device 100 according to an embodiment of the present invention. The variable valve operating device 100 includes a rocker arm type mechanical valve train. A drive cam 122, which is installed over a camshaft 120, converts a rotary motion of the camshaft 120 to a swing motion of a rocker arm (valve support member) 110. The swing motion of the rocker arm is then converted to a vertical reciprocating motion of a valve 104 that is supported by the rocker arm 110. The drive cam 122 has two cam surfaces 124*a* and 124*b*, which differ in profile. One cam surface, which is a nonoperating surface 124*a*, is formed at a fixed distance from the center of the camshaft 120. The other cam surface, which is an operating surface 124*b*, is formed so that the distance from the center of the camshaft 120 gradually increases and then gradually decreases after the apex. In this document, the term "drive cam surface 124" is used when the nonoperating surface 124*a* and operating surface 124*b* are not distinguished from each other.

In the variable valve operating device 100, the drive cam 122 does not directly drive the rocker arm 110. An adjustment mechanism 130 is positioned between the drive cam 122 and rocker arm 110 to coordinate the swing motion of the rocker arm 110 with the rotary motion of the drive cam 122. The variable valve operating device 100 can exercise variable control over the adjustment mechanism 130 to continuously change the coordination between the rotary motion of the drive cam 122 and the swing motion of the rocker arm 110. This makes it possible to vary the swing amount and swing timing of the rocker arm 110, thereby continuously changing the lift amount and valve timing of the valve 104.

As described below, the adjustment mechanism 130 mainly comprises a control shaft 132, a swing cam arm (swing member) 150, a control arm (control member) 160, a control link (link member) 164, a first roller 170, a second roller 172, and a coupling shaft 174, which couples the first roller 170 to the second roller 172. The control shaft 132 is parallel to the camshaft 120. The position of the control shaft 132 relative to the camshaft 120 is fixed so that the control shaft 132 is positioned downstream of the rocker arm 110 in the rotation direction of the camshaft 120. A first gear 134, which is concentric with the control shaft 132, is installed over an outer circumferential surface of the control shaft 132 and fastened to the control shaft 132. An actuator (not shown) such as a motor is connected to the control shaft 132. An ECU for an internal combustion engine can adjust the rotation position of the control shaft 132 as desired by controlling the actuator.

The swing cam arm 150 is supported by the control shaft 132 and allowed to swing. The leading end of the swing cam arm 150 is positioned upstream in the rotation direction of the drive cam 122. A slide surface 156 that comes into contact with the second roller 172 is formed on the side on which the swing cam arm 150 faces the drive cam 122. The slide surface 156 is gradually curved toward a surface of the drive cam 122, and formed so that the distance from a cam base circle (nonoperating surface 124*a*) of the drive cam 122 increases with an increase in the distance from the center of the control shaft 132, which is a swing center.

A swing cam surface 152 is formed on the side opposite the slide surface 156 of the swing cam arm 150. The swing cam surface 152 is a cam surface whose cam center coincides with the swing center of the swing cam arm 150, and comprises a nonoperating surface 152*a* and an operating surface 152*b*, which have different profiles. The nonoperating surface 152*a* is a circumferential surface of the cam base circle and formed at a fixed distance from the center of the control shaft 132. The other surface, which is the operating surface 152*b*, is positioned toward the leading end of the swing cam arm 150 as viewed from the nonoperating surface 152*a*, connected smoothly and contiguously to the nonoperating surface 152*a*, and formed so that the distance from the center of the control shaft 132 (that is, the cam height) gradually increases with a decrease in the distance to the leading end of the swing cam arm 150. In this document, the term "swing cam surface 152", is used when the nonoperating surface 152*a* and operating surface 152*b* are not distinguished from each other.

The variable valve operating device 100 employs a one-cam, two-valve drive structure in which one drive cam 122 drives two valves 104. Therefore, the swing cam arm 150 is positioned on both sides of the drive cam 122 as shown in the front view (schematic diagram) in FIG. 3. The rocker arm 110 is provided for each swing cam arm 150. The swing cam surface 152 of a swing cam arm 150 is in contact with a rocker roller 112 for the rocker arm 110. The rocker roller 112 is mounted on the middle of the rocker arm 110 and allowed to rotate freely. One end of the rocker arm 110 is provided with a valve shaft 102, which supports the valve 104. The other end of the rocker arm 110 is supported by a hydraulic lash adjuster 106 and allowed to turn freely. A valve spring (not shown) presses the valve shaft 102 in the closing direction, that is, in the direction of pushing up the rocker arm 110. The rocker arm 110 is supported by the valve shaft 102, which is pressed by the valve spring. The hydraulic lash adjuster 106 presses the rocker roller 112 against the swing cam surface 152.

The swing cam arm 150 is provided with a spring seat 158 for engagement with a lost motion spring (not shown). The spring seat 158 relates to the nonoperating surface 152*a* and is formed on the side opposite the operating surface 156*b*. The lost motion spring is a compression spring. Its remaining end is secured by a stationary member (not shown). The spring force that the lost motion spring applies to the spring seat 158 presses the swing cam arm 150 to rotate it toward the slide surface 156.

The control arm 160 is supported by the camshaft 120 and allowed to rotate. The control arm 160 is provided with a second gear 162, which is fan-shaped and formed around the rotation center of the control arm 160, that is, along an arc concentric with the camshaft 120. The position of the control arm 160 on the camshaft 120 is adjusted so that the second gear 162 is in the same plane as the first gear 134. Further, the rotation phase of the control arm 160 is adjusted so that the second gear 162 faces the first gear 134. The second gear 162 meshes with the first gear 134, and the rotation of the control shaft 132 is input to the control arm 160 via the first gear 134 and the second gear 162. In other words, the first gear 134 and the second gear 162 constitute a rotation interlock mechanism that interlocks the rotation of the control arm 160 with that of the control shaft 132. Further, the second gear 162 has a larger diameter than the first gear 134. Therefore, the first gear 134 and the second gear 162 also constitute a speed reducing mechanism that decelerates the rotation of the control shaft 132 and transmits the decelerated rotation to the control arm 160.

Figure 2:
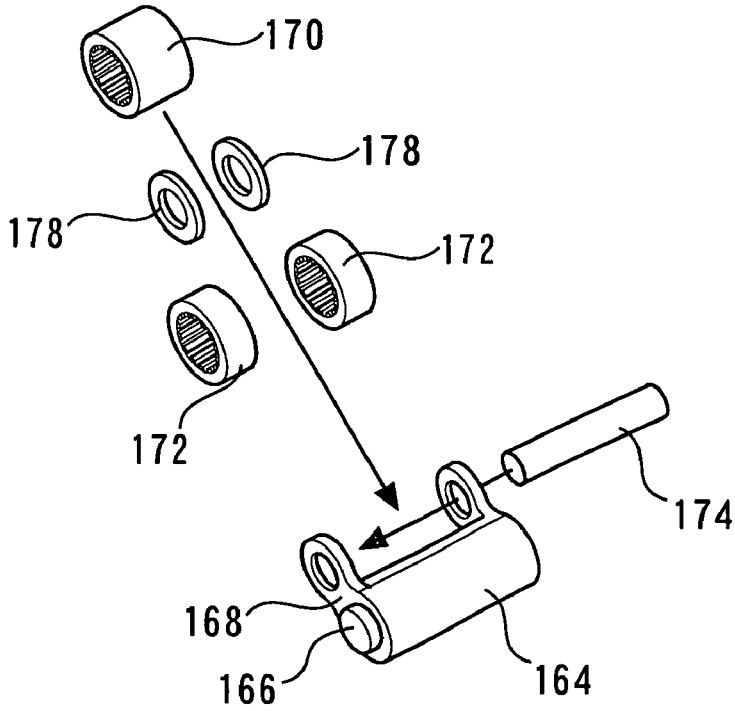
FIG. 2 is an exploded view illustrating a roller support structure.
Figure 3:
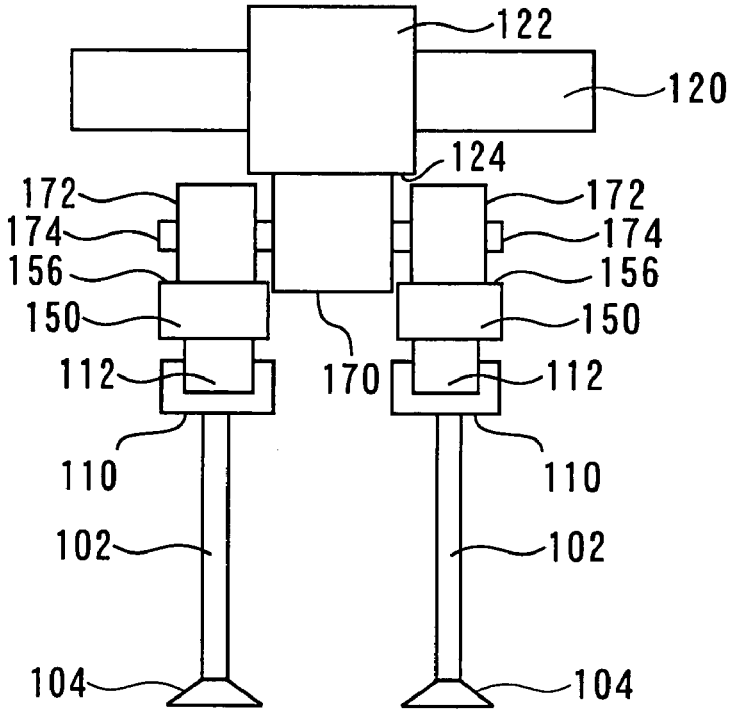
FIG. 3 is a front view (schematic diagram) illustrating the configuration of the variable valve operating device.

The control arm 160 is provided with the control link 164. The control link 164 is positioned eccentrically to the center of the camshaft 120, which is the turning center of the control arm 160, and allowed to rotate freely. The control link 164 has connection pins 166 (only one of them is shown in FIG. 2). The connection pins 166 are mounted on both ends of the fulcrum side of the control link 164. The connection pins 166 are supported by the control arm 160 and allowed to rotate freely. The connection pins 166 on the control arm 160 are positioned virtually opposite the second gear 162 with respect to the turning center of the control arm 160. The leading end of the control link 164 is oriented toward the control shaft 132 while the connection pins 166 serve as a fulcrum. Each side of the drive cam 122 is provided with the control arm 160 (although it is not fully indicated in FIG. 1). The control link 164 is supported by the right- and left-hand control arms 160.

The control link 164 has a pair of arms 168 (right- and left-hand arms) as shown in the exploded view in FIG. 2. The right- and left-hand arms 168 support the coupling shaft 174. The coupling shaft 174 is press-fit into, crimped to, or otherwise fastened to the arms 168. The first roller 170 is supported by the coupling shaft 174 and allowed to rotate freely. The two second rollers 172, which are positioned on both sides of the first roller 170, are supported by the coupling shaft 174 and allowed to rotate freely. Washers 178 are positioned between the first roller 170 and the second rollers 172 so that the rollers 170, 172, which rotate at different speeds, do not come into direct contact with each other. The first roller 170 has a larger diameter and a greater axial length than the second rollers 172.

The leading end of the control link 164 is oriented toward the control shaft 132 so that the control link 164 faces in the drawing direction of the swing cam arm 150. The rollers 170, 172 are positioned between the drive cam surface 124 and slide surface 156. As shown in the front view (schematic diagram) in FIG. 3, the first roller 170 is in contact with the drive cam surface 124, and the second rollers 172 are in contact with the slide surface 156 of each swing cam arm 150. The force that each swing cam arm 150 receives from the lost motion spring causes the slide surface 156 to push up the second rollers 172. The first roller 170, which is coaxial and integral with the second rollers 172, is pressed against the drive cam surface 124.

[Operations Performed by Variable Valve Operating Device According to Present Embodiment]

Operations performed by the variable valve operating device 100 will now be described with reference to FIGS. 4 to 7. In FIGS. 4 to 7, the front control arm 160 and the first gear 134 are omitted in order to properly illustrate the movements of the rollers 170 and 172.

(1) Lift Operation of Variable Valve Operating Device

Figures 4A, 4B:
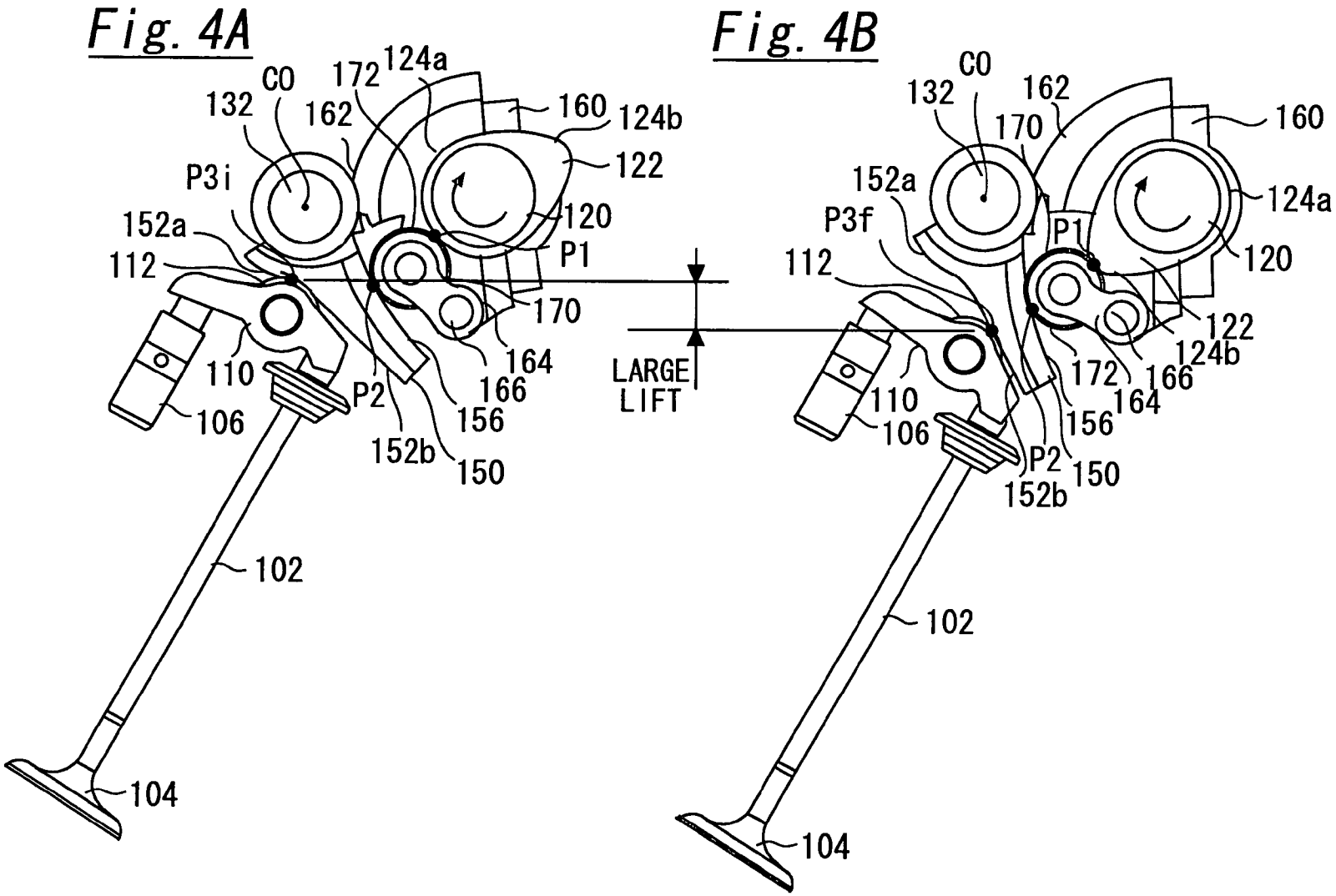
FIGS. 4A and 4B illustrate how the variable valve operating device operates during a great lift, and more specifically.

A lift operation performed by the variable valve operating device 100 will now be described with reference to FIGS. 4A and 4B. FIG. 4A shows a state of the variable valve operating device 100 that prevails when the valve 104 is closed in a lift operation sequence. FIG. 4B shows a state of the variable valve operating device 100 that prevails when the valve 104 is open in the lift operation sequence.

In the variable valve operating device 100, the rotary motion of the drive cam 122 is first input to the first roller 170, which comes into contact with the drive cam surface 124. The first roller 170 and the second rollers 172, which are coaxial and integral with each other, turn on the pin 166. The turning motion is input to the slide surface 156 of the swing cam arm 150, which supports the second rollers 172. Since the force of the lost motion spring (not shown) constantly presses the slide surface 156 against the second rollers 172, the swing cam arm 150 swings on the control shaft 132 in accordance with the rotation of the drive cam 122.

More specifically, when the camshaft 120 rotates in the state shown in FIG. 4A, the contact position P1 at which the first roller 170 contacts the drive cam surface 124 shifts from the nonoperating surface 124*a* to the operating surface 124*b* as indicated in FIG. 4B. Relatively, the first roller 170 is pushed downward by the drive cam 122. Then, the first roller 170 and the second rollers 172, which are coaxial and integral with the first roller 170, turn along a locus that is defined by the control link 164. This causes the second rollers 172 to push the slide surface 156 of the swing cam arm 150 downward. The swing cam arm 150 then turns clockwise, in FIGS. 4A and 4B, around the control shaft 132. When the camshaft 120 further rotates until the contact position P1 at which the first roller 170 contacts the drive cam surface 124 passes the apex of the operating surface 124*b*, the force generated by the lost motion spring and valve spring causes the swing cam arm 150 to turn counterclockwise, in FIGS. 4A and 4B, around the control shaft 132.

When the swing cam arm 150 turns around the control shaft 132 as described above, the contact position P3 at which the rocker roller 112 contacts the swing cam surface 152 changes. In FIGS. 4A and 4B, the contact positions at which the rocker roller 112 contacts the swing cam surface 152 are designated P3*i* and P3*f*. This is to distinguish between an initial contact position P3*i* and a final contact position P3*f*, which will be described later. In this document, the term "contact position P3" is used to simply represent a contact position at which the rocker roller 112 contacts the swing cam surface 152.

When the rocker roller 112 is in contact with the nonoperating surface 152*a* as indicated in FIG. 4A, the distance between the nonoperating surface 152*a* and the center of the control shaft 132 is fixed. Therefore, the position of the rocker roller 112 within the space remains unchanged without regard to the contact position. Consequently, the rocker arm 110 does not swing so that the valve 104 is maintained at a fixed position. When the rocker roller 112 is in contact with the nonoperating surface 152*a*, the positional relationship among the components of the variable valve operating device 100 is adjusted so as to close the valve 104.

When the contact position P3 at which the rocker roller 112 contacts the swing cam surface 152 changes from the nonoperating surface 152*a* to the operating surface 152*b* as indicated in FIG. 4B, the rocker arm 110 is pushed downward in accordance with the distance between the operating surface 152*b* and the center of the control shaft 132. This causes the rocker arm 110 to swing clockwise around a point that is supported by the hydraulic lash adjuster 106. The valve 104 is then pushed downward and opened by the rocker arm 110.

(2) Lift Amount Change Operation of Variable Valve Operating Device

Figures 5A, 5B:
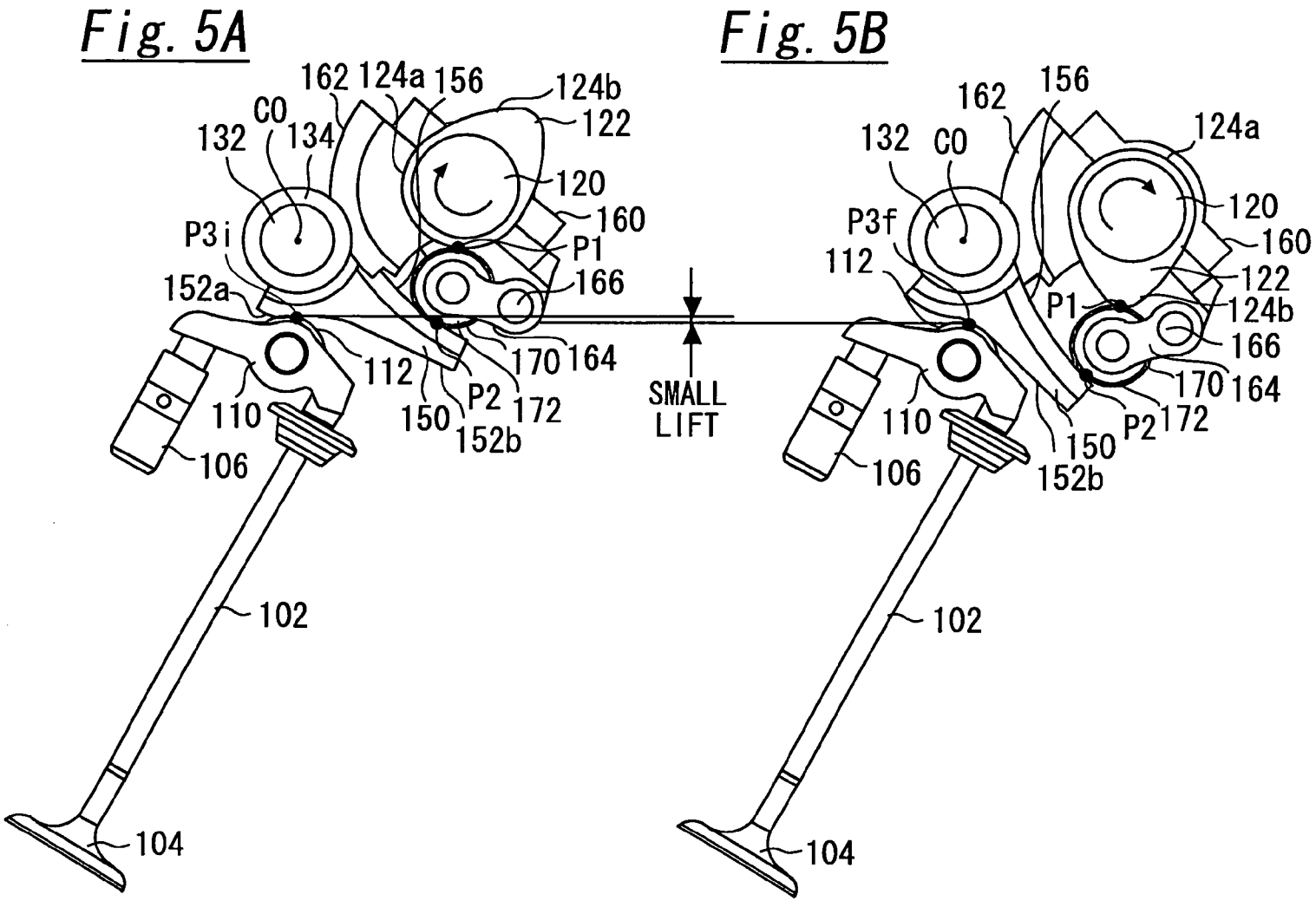
FIGS. 5A and 5B illustrate how the variable valve operating device operates during a small lift, and more specifically.

A lift amount change operation performed by the variable valve operating device 100 will now be described with reference to FIGS. 4 to 7. FIGS. 5A and 5B illustrate an operation in which the variable valve operating device 100 gives a small lift to the valve 104. On the other hand, FIGS. 4A and 4B illustrate an operation in which the variable valve operating device 100 gives a great lift to the valve 104. FIGS. 4A and 5A show a state of the variable valve operating device 100 that prevails when the valve 104 is closed in a lift operation sequence. FIGS. 4B and 5B show a state of the variable valve operating device 100 that prevails when the valve 104 is open in the lift operation sequence.

When the lift amount is to be changed from the lift amount shown in FIGS. 4A and 4B to the lift amount shown in FIGS. 5A and 5B, the control shaft 132 is rotated in the same direction as the rotation direction of the camshaft 120 (clockwise as viewed in the figures) in the state shown in FIG. 4A, and the control arm 160 is rotated to the rotation position shown in FIG. 5A. The rotation amount of the control arm 160 is determined by the rotation amount of the control shaft 132 and the gear ratio between the first gear 134 (see FIG. 1) and the second gear 162. Both rollers 170, 172 are coupled to the control arm 160 by the control link 164. Therefore, when the control arm 160 rotates, the first roller 170 moves along the drive cam surface 124 and upstream in the rotation direction of the camshaft 120, whereas the second rollers 172 move along the slide surface 156 and away from the control shaft 132.

Figure 6:
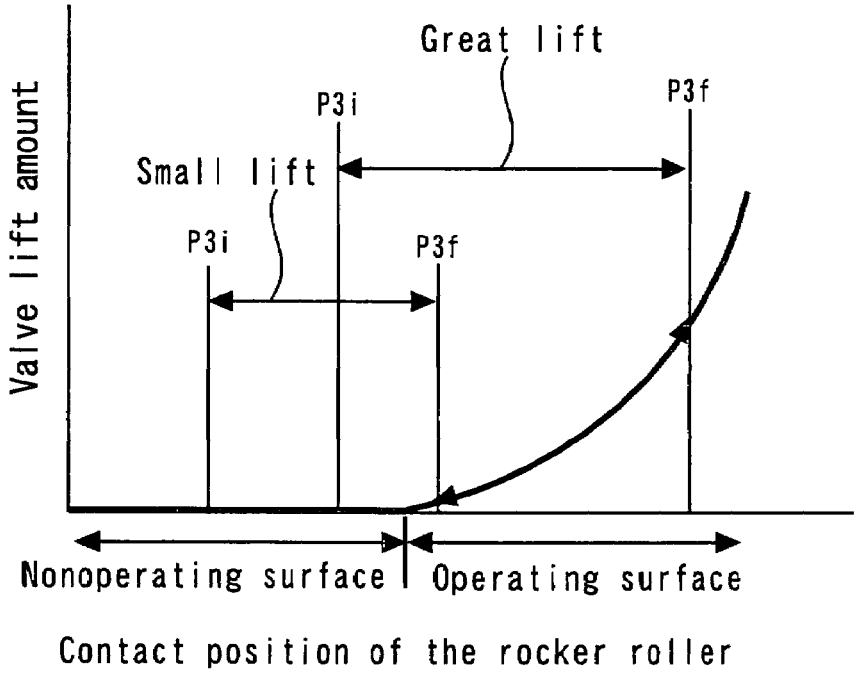
FIG. 6 shows the relationship between a valve lift amount and the position of a rocker roller on a swing cam surface.

When the second rollers 172 move away from the control shaft 132, the distance between the swing center C0 of the swing cam arm 150 and the contact position P2 at which the second rollers 172 contact the slide surface 156 increases, thereby decreasing the swing angle of the swing cam arm 150. The reason is that the swing angle of the swing cam arm 150 is in inverse proportion to the distance between the swing center C0 and the contact position P2, which is an oscillation input point. As indicated in FIGS. 4B and 5B, the lift of the valve 104 is maximized when the contact position P1 at which the first roller 170 contacts the drive cam surface 124 is at the apex of the operating surface 124*b*, and the lift amount of the valve 104 is determined by the contact position P3*f* at which the rocker roller 112 contacts the swing cam surface 152 when the valve lift is maximized (hereinafter referred to as the final contact position). FIG. 6 illustrates the relationship between the valve lift and the position of the rocker roller 112 on the swing cam surface 152. As indicated in FIG. 6, the final contact position P3*f* is determined by the aforementioned swing angle of the swing cam arm 150 and the contact position P3*i* at which the rocker roller 112 contacts the swing cam surface 152 as indicated in FIGS. 4A and 5A (hereinafter referred to as the initial contact position).

In the variable valve operating device 100 according to the present embodiment, the slide surface 156 is formed so that the distance to the cam base circle (nonoperating surface 124*a*) of the drive cam 122 increases with an increase in the distance to the swing center. Therefore, when the aforementioned contact position P2 moves away from the swing center C0 of the swing cam arm 150, the swing cam arm 150 inclines in such a direction that the slide surface 156 approaches the drive cam surface 124. The swing cam arm 150 turns counterclockwise around the control shaft 132 as viewed in the figures. This causes the initial contact position P3*i* of the rocker roller 112 on the swing cam surface 152 to move away from the operating surface 152*b* as indicated in FIG. 5A.

When the control shaft 132 rotates in the same direction as that of the camshaft 120, the swing angle of the swing cam arm 150 decreases and the initial contact position P3*i* moves away from the operating surface 152*b*. Consequently, the final contact position P3*f* that the rocker roller 112 can reach moves toward the nonoperating surface 152*a* as indicated in FIG. 6, thereby decreasing the lift amount of the valve 104. The operating angle of the valve 104 corresponds to a period (crank angle) during which the rocker roller 112 is positioned on the operating surface 152*a*. However, when the final contact position P3*f* moves toward the nonoperating surface 152*a*, the operating angle of the valve 104 also decreases. Further, the first roller 170 moves upstream in the rotation direction of the camshaft 120. Therefore, the contact position P1 at which the first roller 170 contacts the drive cam surface 124 when the camshaft 120 is at the same rotation position moves toward the advance angle side of the drive cam 122. This advances the swing timing of the swing cam arm 150 in relation to the phase of the camshaft 120. As a result, the valve timing (maximum lift timing) advances.

Figure 7:
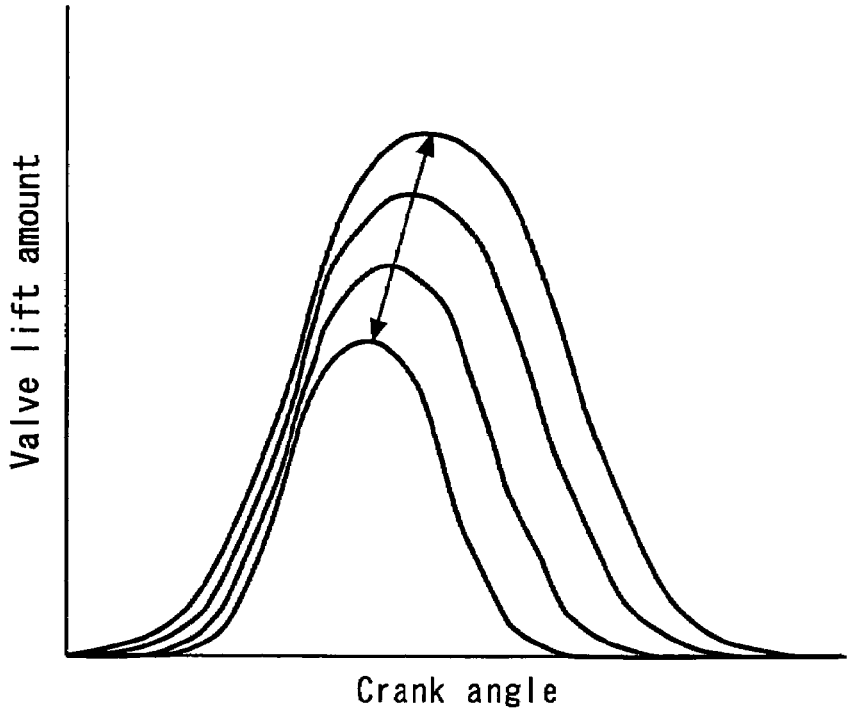
FIG. 7 shows the relationship between valve timing and lift amount.

FIG. 7 is a graph illustrating the relationship between the lift amount and valve timing of the valve 104, which are provided by the variable valve operating device 100. As shown in this figure, the variable valve operating device 100 can increase the operating angle and retard the valve timing when the lift amount of the valve 104 increases. Conversely, the variable valve operating device 100 can decrease the operating angle and advance the valve timing when the lift amount of the valve 104 decreases. Therefore, if, for instance, the valve 104 is an intake valve, it is possible to exercise variable control over the operating characteristic without using a VVT or other valve timing control mechanism so that the opening timing of the valve 104 remains virtually fixed.

[Advantages of Variable Valve Operating Device According to Present Embodiment]

When driving force is transmitted from the drive cam 122 to the swing cam arm 150, contact surface pressure (Hertzian stress) is exerted between the drive cam surface 124 and the first roller 170 and between the slide surface 156 and the second rollers 172. In the variable valve operating device 100 according to the present embodiment, the first roller 170 has a larger diameter than the second rollers 172. Therefore, the contact surface pressure (Hertzian stress) between the drive cam surface 124 and the first roller 170 is reduced. Further, since the second rollers 172 do not come into contact with the drive cam surface 124, the drive cam surface 124 can be brought into contact with the overall width of the first roller 170. The resulting increase in the contact length also reduces the contact surface pressure. Meanwhile, the contact surface pressure between the second rollers 172 and the slide surface 156 is reduced because the slide surface 156 is formed as a concave surface that is curved toward the drive cam surface 124. Consequently, the variable valve operating device 100 according to the present embodiment provides increased durability.

Further, since the second rollers 172 have a smaller diameter than the first roller 170, the distance between the drive cam surface 124 and slide surface 156 is suppressed. Furthermore, since the second rollers 172 do not come into contact with the drive cam surface 124, the axial length of the variable valve operating device 100 can be suppressed by positioning the second rollers 172 near the first roller 170. Consequently, the variable valve operating device 100 according to the present embodiment makes it possible to not only provide increased durability by decreasing the contact surface pressure as described above, but also make the whole variable valve operating device compact.

Moreover, since the second rollers 172 are positioned on both sides of the first roller 170, the driving force, which is input from the drive cam surface 124 to the first roller 170, and the reaction force, which is input from the slide surface 156 to the second rollers 172 on both sides, balance at the center of the coupling shaft 174. Therefore, it is possible to provide increased rigidity by inhibiting the coupling shaft 174 from bending, and transmit a driving force uniformly to the two valves 104.

[Other]

While the present invention has been described in terms of a preferred embodiment, it should be understood that the invention is not limited to the preferred embodiment, and that variations may be made without departure from the scope and spirit of the invention. For example, the following modifications may be made to the preferred embodiment of the present invention.

Figure 8:
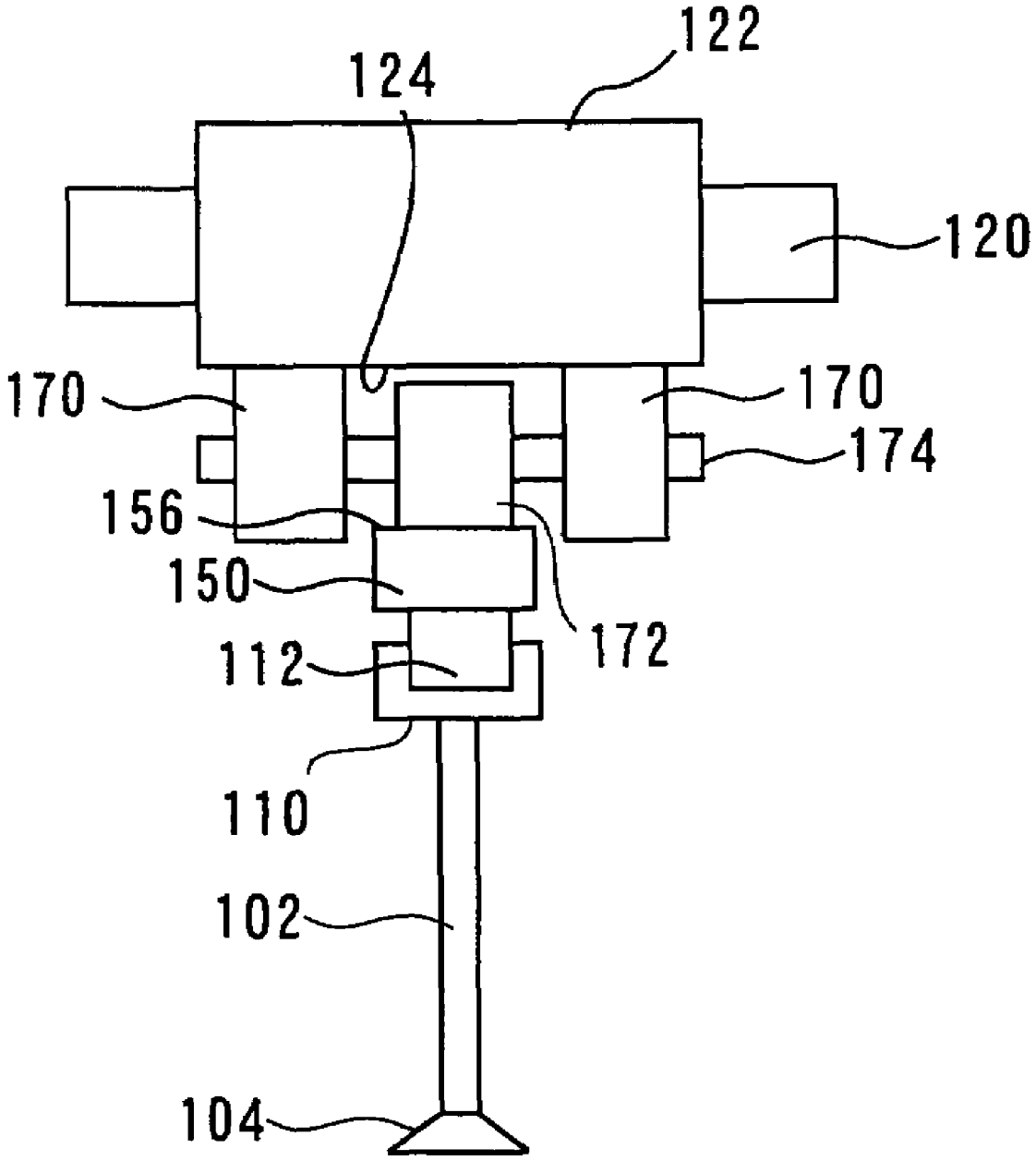
FIG. 8 is a front view (schematic diagram) illustrating the configuration of the variable valve operating device according to another embodiment of the present invention.

The embodiment described above assumes that the present invention is applied to a variable valve operating device having a one-cam, two-valve drive structure. However, the present invention can also be applied to a variable valve operating device having a one-cam, one-valve drive structure. FIG. 8 is a front view (schematic diagram) illustrating a variable valve operating device having a one-cam, one-valve drive structure to which the present invention is applied. When the one-cam, one-valve drive structure is employed, the second roller 172 having a small diameter is positioned at the center and the first rollers 170 having a large diameter are positioned on both sides of the second roller 172, as shown in FIG. 8. The first rollers 170 receive a driving force that is transmitted from the drive cam surface 124, and the second roller 172, which is positioned at the center, transmits the driving force to the slide surface 156. When this configuration is employed, the driving force, which is input from the drive cam surface 124 to the first rollers 170 on both sides, and the reaction force, which is input from the slide surface 156 to the second roller 172 at the center, balance at the center of the coupling shaft 174. Therefore, it is possible to inhibit the coupling shaft 174 from bending and provide increased rigidity.

In the embodiment described above, the present invention is applied to a rocker arm type valve operating device. However, the present invention can also be applied to a direct acting or other valve operating device.

Further, the adjustment mechanism for the variable valve operating device according to the present invention is not limited to the adjustment mechanism 130 that is configured in accordance with the embodiment described above. The present invention can be applied to a wide variety of variable valve operating devices as far as they include an adjustment mechanism that transmits the rotary motion of the drive cam to the swing member via an intermediate member.

The invention claimed is:

1. A variable valve operating device for mechanically changing the operating characteristic of a valve relative to the rotation of a camshaft, the variable valve operating device comprising:

a drive cam installed over the camshaft;

a swing member that swings on a stationary shaft;

a swing cam surface that is formed on the swing member, comes into contact with a valve support member, which supports the valve, and presses the valve in a lifting direction;

a slide surface that is formed on the swing member so as to face the drive cam;

an intermediate member that is positioned between the drive cam and the swing member and comes into contact with both the slide surface and a cam surface of the drive cam;

a control shaft that is positioned in parallel with the camshaft and capable of changing the rotation position continuously or stepwise;

a control member that is installed over the camshaft and allowed to rotate;

a support member that is mounted on the control member to support the intermediate member so that the intermediate member can be moved along a predetermined path in relation to the control member;

a first gear that is installed over the control shaft to rotate together with the control shaft; and a second gear that is installed over the control member to mesh with the first gear;

wherein the intermediate member includes a first roller, which has a large diameter and comes into contact with a cam surface of the drive cam; a second roller, which is positioned concentrically with the first roller, has a small diameter, and comes into contact with the slide surface; and a coupling shaft, which couples the first roller and the second roller so that the first roller and the second roller can rotate independently; and wherein the slide surface is curved toward the drive cam.

2. The variable valve operating device according to claim 1, wherein the variable operating device comprises two second rollers, wherein the two second rollers are positioned on both sides of the first roller; and wherein the two second rollers come into contact with the slide surface to input a driving force to the slide surface.

3. The variable valve operating device according to claim 2, wherein the swing member is provided for each of the two second rollers; and wherein the valve is provided for each of the two swing members.

4. The variable valve operating device according to claim 1, wherein the variable operating device comprises two first rollers, wherein the second roller is positioned between the two first rollers; and wherein each of the two first rollers comes into contact with a cam surface of the drive cam to receive a driving force input from the drive cam.

* * * * *